United States Patent [19]

Mulcahy et al.

[11] 4,434,720

[45] Mar. 6, 1984

[54] MULTI-RATE SIDE BEARING FOR A RAILWAY TRUCK

[75] Inventors: Harry W. Mulcahy, Griffith, Ind.; Horst T. Kaufhold, Chicago, Ill.

[73] Assignee: AMSTED Industries Incorporated, Chicago, Ill.

[21] Appl. No.: 349,717

[22] Filed: Feb. 18, 1982

[51] Int. Cl.[3] ..... B61F 5/14

[52] U.S. Cl. ..... 105/199 CB; 267/3; 267/85; 267/152; 384/423

[58] Field of Search ..... 105/199 CB, 199 F, 199 R, 105/199 C, 200, 201; 384/423, 421, 422; 267/3, 85, 152

[56] References Cited

U.S. PATENT DOCUMENTS

| | | | |
|---|---|---|---|
| 2,327,954 | 8/1943 | Barrows et al. | 384/423 |
| 2,515,853 | 7/1950 | Blattner | 384/423 |
| 3,255,712 | 6/1966 | Barber | 105/200 X |
| 3,575,403 | 4/1971 | Hamel | 267/3 |
| 3,707,927 | 1/1973 | Geyer et al. | 267/3 |
| 3,845,725 | 11/1974 | Gierlach | 105/199 CB |
| 4,080,016 | 3/1978 | Wiebe | 105/199 CB |

*Primary Examiner*—Robert B. Reeves
*Assistant Examiner*—Greg Beehner
*Attorney, Agent, or Firm*—Edward J. Brosius; Fred P. Kostka

[57] ABSTRACT

A multi-rate side bearing for a railway truck is provided. The side bearing comprises a base plate and an upper plate, with two resilient devices located between the base plate and the upper plate. The resilient devices usually are elastomeric pads of different compression rates and shear stiffness. Under unloaded car conditions, only one pad is in load supporting contact, but under loaded car conditions, both resilient devices contact the upper and base plates to provide load support and car body-truck motion damping.

9 Claims, 4 Drawing Figures

MULTI-RATE SIDE BEARING FOR A RAILWAY TRUCK

BACKGROUND OF THE INVENTION

The present invention relates to side bearings for use in a railway truck, and more particularly to a multi-rate side bearing for use in a railway truck.

Typical side bearings in railway trucks comprise two rigid supports mounted on the upper side of the truck bolster on either side of the center plate. These supports may contact a roller or other low friction device or material. A corresponding member extends downward from the car bolster. Under normal car operation, the side bearing members are out of contact with the car bolster, the car load being carried by the center plate. However, under certain operating conditions leading to tilted car operation or car rocking, the side bearings come into contact to prevent extreme tilting which may lead to the car tipping over. Normally, however, the car is balanced in equilibrium on the center plate, and is free to rock about the longitudinal axis of the car.

Auxiliary side bearings located on the truck bolster between the center plate and the typical side bearings have been proposed for further car stabilization. Such auxiliary side bearings are shown in U.S. Pat. Nos. 3,400,669; 3,406,641 and 3,533,359. The object of such auxiliary side bearings is to provide improved resistance to rocking and accordingly improved load sharing laterally cross the truck bolster.

Studies have indicated that enhanced lateral stability, curving and roll stability can be achieved by specific combinations of primary and secondary suspension stiffness and damping parameters. Further, the truck bolster-car body yaw stiffness and damping are also seen to have significant influence on curving and lateral stability.

The secondary suspension system of a railway car truck consists of the main springs supporting the bolster within the side frames. This secondary suspension system of the railway car truck can be designed to provide satisfactory control of roll stability, longitudinal pitch and vertical ride quality by appropriate selection of spring rates and friction damper forces. The specific values of these parameters are dependent on vehicle weight and design, as well as such outside conditions as track geometry.

The present day railway car truck is unable to provide the desired low lateral spring rate between the empty car body and itself, since the lateral and vertical stiffness and damping forces are provided by the same springs and friction elements, although at differing rates. The introduction of constant contact side bearings provided a means of controlling truck hunting, but this was accomplished at the expense of curving performance. This is believed by some to contribute to derailment in curving, especially at low speeds.

The present invention overcomes the problems of known side bearings and provides desired stability and damping.

SUMMARY OF THE PRESENT INVENTION

The present invention provides an improved side bearing in the form of a multi-rate side bearing. The typical rigid side bearing is not required. Located on top of the truck bolster on either side of the center plate, the multi-rate side bearing comprises a base plate that is adapted to fit on the truck bolster. Having outside edges, side edges and an inner edge, the base plate is adapted to usually accommodate two resilient devices, usually in the form of elastomeric pads, in what may be considered pad pockets. A complementary upper plate is provided which fits over the resilient devices. The upper plate has a friction wear liner fitted in its top surface. This is desired to permit the body bolster which has a wear surface that rests on the wear liner to slide along the wear liner consequently providing lateral and yaw damping.

The first resilient device, usually an elastomeric pad, is usually fitted top and bottom with metal plates. This first resilient device is, under empty car conditions, in contact with the upper and base side bearing plates, and, with the corresponding device on the other side of the center plate, supports the entire weight of the empty car. Accordingly, under empty car conditions, the center plate does not contact the bottom of the center plate opening of the truck bolster, which is usually fitted with a friction wear liner.

The second resilient device, usually an elastomeric pad of greater rates of compression and shear stiffness than the first resilient device, is located next to the first resilient device in the base and upper side bearing plates. It is usually fitted top and bottom with metal plates. The top plate usually has sloped edges that correspond to sloped surfaces of the flanged edges on the upper plate. The upper surface of the top plate of the second resilient device usually is not in contact with the lower surface of the upper plate under empty car conditions. Thus, under empty or lightly loaded car conditions, low lateral stiffness is provided.

With lateral forces acting on the car body in the empty car condition, the first resilient device will deform in lateral shear. At a force level which is predetermined by the car body weight and the coefficient of friction of the interface materials, slippage between the body bolster and the side bearing wear liner occurs, consequently providing the desired level of lateral damping between the body bolster and the side bearing. The amount of upper plate slide may be limited by the contact of the sloped surfaces of the upper plate and the sloped edges of the top plate of the second resilient device.

The majority of yaw stiffness is provided by the shear properties of the second resilient device which is mounted in the base and upper side bearing plates outward of the first resilient device. The balance of the yaw stiffness is provided by the first resilient device. Flanges depending from the upper side bearing plate contact the corresponding edges on the top plate of the second resilient device under such yaw conditions. The first resilient device is simultaneously moved in a shearing manner in the yaw direction due to the retention pockets in the upper and base side bearing plates. In the event that the yaw torque exceeds the predetermined yaw breakout torque, slippage between the side bearing friction wear liner and the body bolster provides friction damping of the yaw motion.

Under loaded car conditions, the first resilient device will be compressed, and the car body will exert sufficient force to cause the upper plate to contact the second resilient device and the center plate to contact the bottom of the truck bolster center plate opening. At this point, further compression is inhibited, and the car body vertical load will then be shared by both multi-rate side bearings and the center plate. In the event of relative roll motion occurring between the car body and the truck bolster, such motions are resisted by compression of the stiff outer second resilient device. The second resilient device, having a higher shear rate than the first resilient device, provides for the majority of the lateral stiffness. The balance of the lateral stiffness is provided by the first resilient device. With lateral forces acting on the car body, lateral movement of the body bolster requires that lateral forces acting on the car body exceed the breakout limit between center plate and truck bolster center plate wear liner. The lateral forces acting on the car body will then move both resilient devices in shear, with no relative motion as yet occurring between the body bolster and the side bearing wear liner. Finally, when the limit of friction force between the body bolster and the side bearing wear liner has been reached, the body bolster will frictionally slip laterally across the side bearing wear liner, and thus provide friction damping of this motion.

DESCRIPTION OF THE PREFERRED EMBODIMENT

Figure 1:
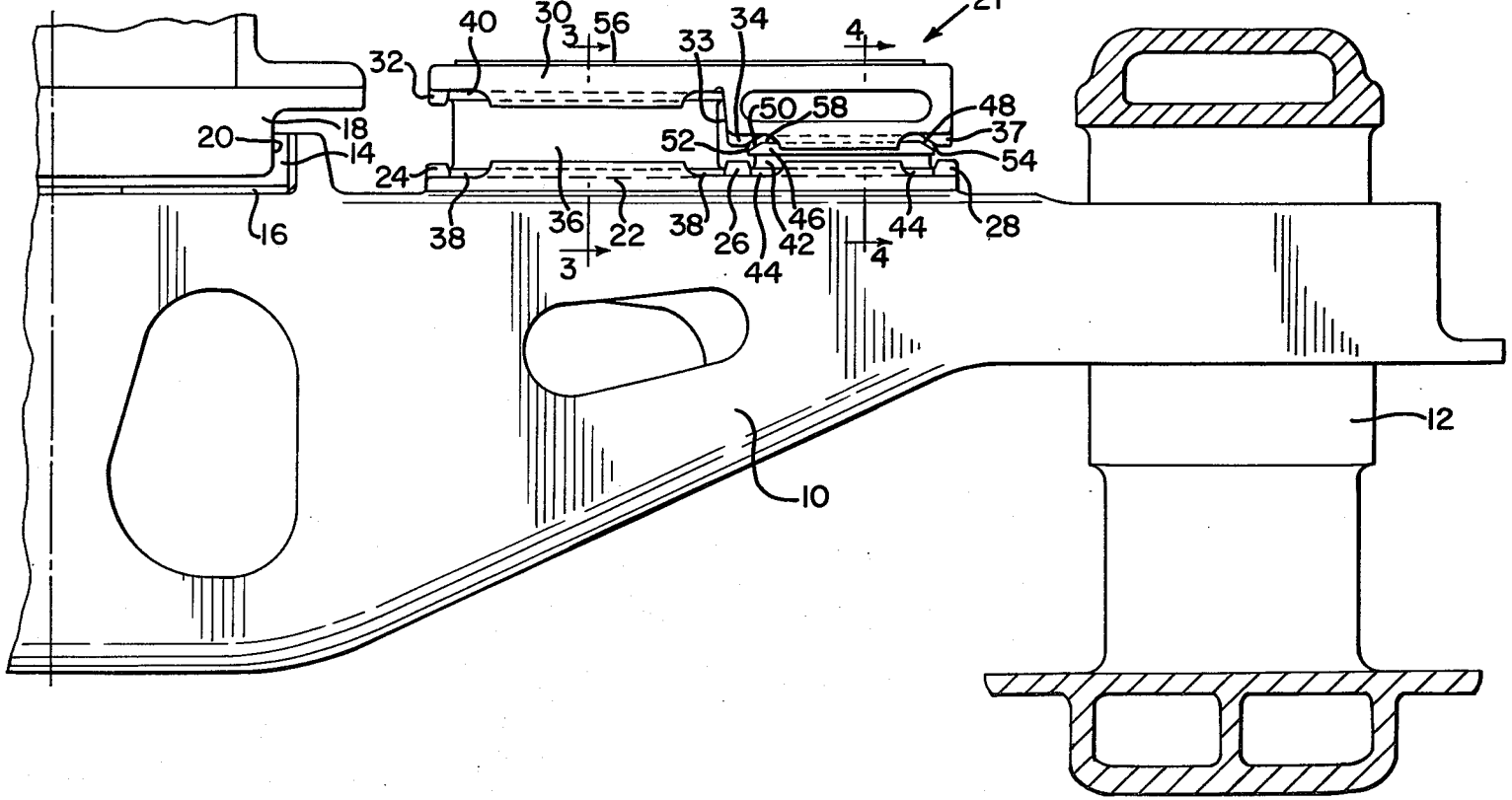
FIG. 1 is a partial side cross sectional view of the bolster and side bearing of the present invention.
Figure 2:
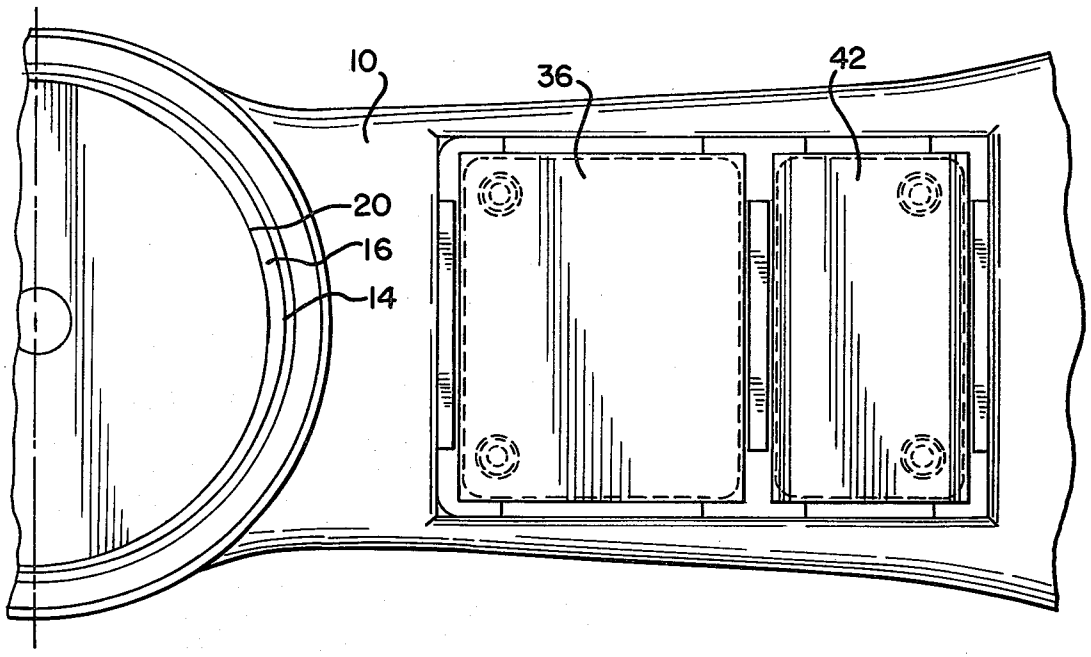
FIG. 2 is a partial cross sectional top view of the bolster and side bearing of the present invention.

As seen in FIGS. 1 and 2, a section of railway truck bolster 10 is shown extending into an opening in side frame 12. Centrally located in bolster 10 is center plate opening 14, which is of generally circular configuration. On the bottom of center plate opening 14 is a friction wear liner 16, usually made of plastic or similar material. Center plate 18 has a lower portion 20 which extends into outer plate opening 14, and under unloaded car conditions does not contact truck bolster center plate wear liner 16. Lower section 20 of center plate 18 is not circular, but is eccentric, with its width in the lateral direction along the bolster being less than its length in the transverse direction to the bolster. This allows movements of the car body, which is affixed to the center plate by a king pin (not shown), in a lateral direction to the bolster. Such movement is damped, however, as explained below.

Figure 3:
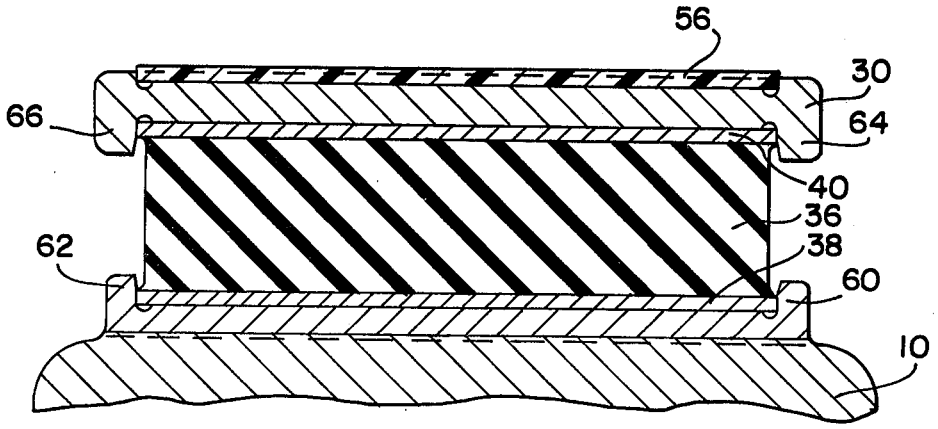
FIG. 3 is a cross sectional view along 3—3 of FIG. 1.
Figure 4:
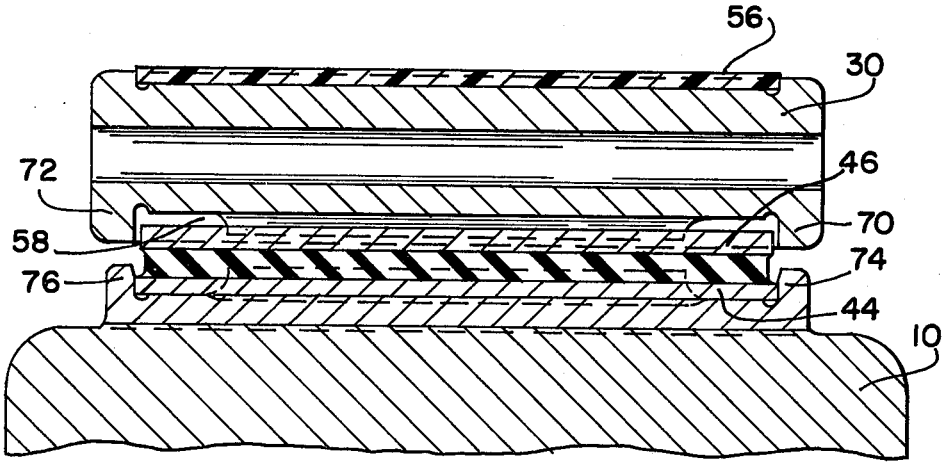
FIG. 4 is a cross sectional view along 4—4 of FIG. 1.

A side bearing 21 is located on the top of bolster 10. A corresponding side bearing is located on the opposite side of center plate 18 with identical parts. Side bearing 21 comprises generally rectangular base plate 22 having raised edge 24, inner rib 26 and raised edge 28. As seen in FIGS. 3 and 4, base plate 22 also comprises raised side edges 60, 62 and 74, 76. Side bearing 21 also comprises a generally rectangular upper plate 30 having edge flange 32, depending edge 33, inner flange 34 and lower edge flange 37. As seen in FIGS. 3 and 4, upper plate 30 also comprises raised side edges 64, 66 and 70, 72. Base plate raised edge 24 and inner rib 26 and side edges 60 and 62 together with upper plate edge flange 32 and depending edge 33 form a pocket to receive a first resilient device 36. First resilient device 36 is a generally rectangular elastomer pad. A bottom plate 38 and a top plate 40 are affixed to resilient device 36. Plates 38 and 40 are usually metal and contact base plate 22 and upper plate 30 under unloaded railway car conditions.

Side bearing 21 further comprises a second resilient device 42, which comprises a generally rectangular elastomer pad. Base plate inner rib 26 and raised edge 28 and side edges 74 and 76 form a pocket into which resilient device 42 is placed. Resilient device 42 has a bottom plate 44 and a top plate 46. Plates 44 and 46 are usually metal. Top plate 46 is, under unloaded car conditions, not in contact with upper plate 30. Top plate 46 has angled edge surfaces 48 and 50, and upper plate inner flange 34 and lower edge flange 37 have corresponding angled surfaces 52 and 54. Under loaded car conditions, the car body (not shown) which rests on friction wear liner 56 on top of upper plate 30 forces downward on first resilient device 36 enough to compress it. The gap 58 between upper plate 30 and top plate 46 of second resilient device 42 which is present under unloaded car conditions is closed, and top plate 46 contacts upper plate 30, and further the gap between center plate 18 and friction liner 16 of the truck bolster center plate opening 14 is closed, and center plate 18 contacts liner 16. The car body weight is then distributed over the center plate and both resilient devices of both side bearings.

Side bearing first resilient device 36 is usually compresed of an elastomer pad as is second resilient device 42. The compression rate of first resilient device 36 is usually less than that of second resilient device 42. The compression rate for resilient device 36 is on the order of 0.25 times the empty car weight in units of pounds per inch. The shear ratio of first resilient device 36 is also usually less than that of second resilient device 42.

Under empty car conditions, it is possible for first resilient device 36 to be laterally deformed due to the car body exerting lateral or shear forces on the upper plate 30 through its contact with wear liner 56. The forces acting on upper plate 30 cause the upper plate to shift laterally. However, such lateral shifting of upper plate 30 may be limited by either of the angled side surfaces 48 or 50 of top wear plate 46 of second resilient device 42 contacting (depending on direction of lateral force) the shifting upper plate 30 on either of corresponding angled surfaces 52 or 54 of flanges 34 and 37 depending on truck design.

What is claimed is:

1. A railway truck comprising a truck bolster, a center plate opening in the truck bolster adapted to receive a center plate therein, two side bearing assemblies on the top surface of the truck bolster with one of said side bearing assemblies located on each side of the center plate opening, each side bearing assembly comprising a base plate affixed to the truck bolster and an upper plate, a first resilient device located between the base plate and the upper plate, and a second resilient device located between the base plate and the upper plate and outboard in relation to said center plate opening from the first resilient device, said first resilient device having a lower compression rate than the second resilient device, and said first resilient device having a lower shear rate than the second resilient device.

2. In the railway truck of claim 1, wherein under unloaded car conditions, the first resilient device contacts the upper plate and the base plate, and the second resilient device contacts the base plate and a gap exists between the second resilient device and the upper plate and a gap exists between the center plate and the center plate opening.

3. In the railway truck of claim 1, wherein under loaded car conditions the first resilient device contacts the upper plate and the base plate, and the second resilient device contacts the upper plate and the base plate and the center plate contacts the center plate opening.

4. In the railway truck of claim 1, wherein the resilient devices are comprised of an elastomeric material.

5. In the railway truck of claim 1, wherein the center plate opening is circular and the center plate is eccentric to provide a lateral gap permitting the lateral movement of the car body supported on the bolster.

6. A side bearing for use in a railway truck, said side bearing comprising a base plate and an upper plate, a first resilient device located between the base plate and the upper plate, and a second resilient device located between the base plate and the upper plate and laterally outboard from the first resilient device, the first resilient device having a lower compression rate than the second resilient device, and the first resilient device having a lower shear rate than the second resilient device.

7. The side bearing of claim 6, wherein under unloaded car conditions, the first resilient device contacts the upper plate and the base plate, and the second resilient device contacts the base plate and a gap exists between the second resilient device and the upper plate.

8. The side bearing of claim 6, wherein under loaded car conditions, the first resilient device contacts the upper plate and the base plate and the second resilient device contacts the upper plate and the base plate.

9. The side bearing of claim 6, wherein the resilient devices are comprised of an elastomeric material.

* * * * *